United States Patent [19]

von Allmen

[11] 4,136,489

[45] Jan. 30, 1979

[54] GRINDING AND POLISHING MACHINE

[75] Inventor: Pierre von Allmen, Neuchatel, Switzerland

[73] Assignee: Esco S.A., Switzerland

[21] Appl. No.: 747,186

[22] Filed: Dec. 3, 1976

[30] Foreign Application Priority Data

Dec. 10, 1975 [FR] France ..... 75 38401
Oct. 4, 1976 [FR] France ..... 76 30410

[51] Int. Cl.[2] ..... B24B 3/60; B24B 41/04

[52] U.S. Cl. ..... 51/98 BS; 51/125; 51/166 T

[58] Field of Search ..... 51/3, 4, 72 R, 72 L, 51/98 R, 98 BS, 98 SP, 98.5, 166 T, 166 TS, 101 LG, 125.5, 125

[56] References Cited

U.S. PATENT DOCUMENTS

| | | | |
|---|---|---|---|
| 925,867 | 6/1909 | Bryant | 51/166 T |
| 1,528,188 | 3/1925 | Frost | 51/166 T |
| 1,905,651 | 4/1933 | Raule | 51/166 T |
| 2,748,540 | 6/1956 | St. George | 51/166 T X |
| 3,019,562 | 2/1962 | Price | 51/3 |

*Primary Examiner*—N. P. Godici
*Attorney, Agent, or Firm*—Robert E. Burns; Emmanuel J. Lobato; Bruce L. Adams

[57] ABSTRACT

A machine for successively grinding and polishing tools such as gravers of hard metal has grinding and polishing wheels mounted in parallel shafts on a support which can be moved to bring either wheel to face a tool held in a workpiece holder. The polishing wheel can be moved to an extreme position which is precisely set by a micrometer screw so that it comes to occupy exactly the same position formerly occupied by the grinding wheel. Alternatively, the workpiece-carrier can be moved by a cam system to exactly position the tool against the two wheels.

4 Claims, 8 Drawing Figures

FIG. 4
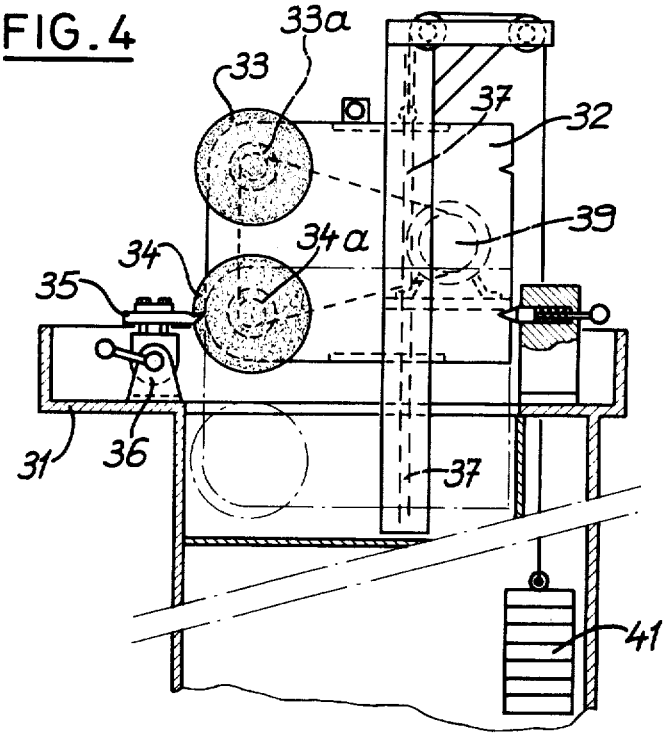
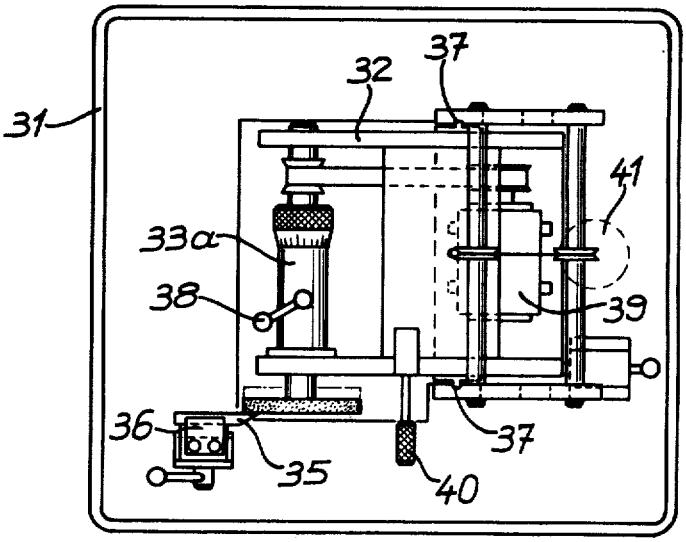
FIG. 3

GRINDING AND POLISHING MACHINE

BACKGROUND OF THE INVENTION

The invention relates to machines for grinding and polishing tools such as gravers or burins of hard metal and similar workpieces.

In known grinding and polishing machines, the workpiece is firstly placed against the grinding wheel and, after grinding, is placed against a polishing wheel which polishes the ground surface of the workpiece.

The main disadvantage of successively placing the workpiece against the two wheels is that great care must be taken to exactly place the ground surface against the polishing wheel so that it does not hit and possibly damage the polishing wheel.

An object of the invention is to obviate this important drawback.

SUMMARY OF THE INVENTION

According to the invention, a machine for successively grinding and polishing workpieces, in particular tools such as gravers of hard metal, comprises a frame, a workpiece carrier on the frame, and a grinding wheel and a polishing wheel rotatably mounted about parallel axes on at least one support movable relative to the frame between a first position in which an operative surface of the grinding wheel is placed to grind a workpiece carried by said carrier and a second position in which an operative surface of the polishing wheel is placed to polish the workpiece. One of the polishing wheel and the workpiece carrier is mounted for movement relative to the other and relative to the grinding wheel along a given direction generally perpendicular to said operative surfaces. Means are provided for precisely setting an extreme position of the movable one of the polishing wheel and workpiece carrier in said given direction to limit its movement towards the other and in which extreme position when said at least one support is in the second position the operative surface of the polishing wheel is accurately positioned relative to said workpiece in the same position as the operative surface of the grinding wheel when said at least one support is in its first position. Means are also provided for moving the said movable one of the polishing wheel and workpiece carrier into said predetermined extreme relative position.

Thus it is possible to automatically or semi-automatically make the operative surfaces of the two wheels exactly coincide with the machined surface of the workpiece in both working positions, while compensating for the inevitable differences of the dimensions of the wheels and avoiding any risk of damaging the workpiece or the polishing or grinding wheel when passing from one working position to the other.

BRIEF DESCRIPTION OF THE DRAWINGS

Three embodiments of the invention and one variation are shown, by way of example, in the accompanying schematic drawings, in which:

FIG. 3 is a plan view of the second embodiment;

FIG. 4 is a simplified elevational view of the second embodiment;

DESCRIPTION OF THE PREFERRED EMBODIMENTS

Figure 2:
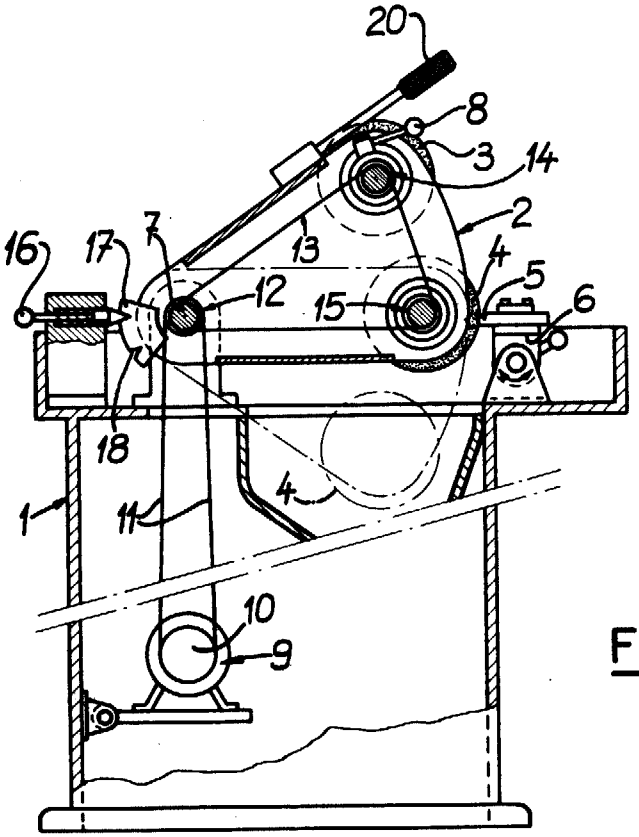
FIG. 2 is a cross-section along line II—II of FIG. 1.
Figure 1:
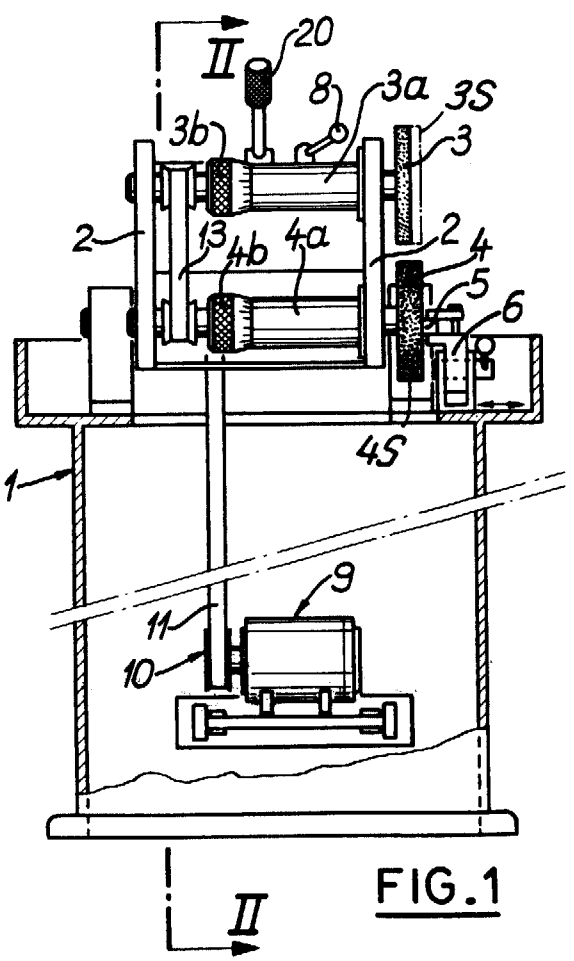
FIG. 1 is an elevational view of the first embodiment.

The machine of FIGS. 1,2 comprises a frame 1 on which a support 2 is pivotally mounted about a shaft 7. The support 2 carries rotatably mounted grinding and polishing wheels 4, 3 cylindrically shaped as shown, for operating on tools 5, for successively grinding and polishing a tool 5 fixed on a workpiece-carrier 6 of known type, in grinding and polishing operations during successive cycles of these operations.

The shafts of wheels 3,4 are rotatably mounted in parallel quills 3*a*, 4*a* carried by spaced-apart plates of the support 2. These shafts are parallel to and are equidistant from the pivoting axis (shaft 7) of the support 2. The quills 3*a*, 4*a* have micrometric screws 3*b*, 4*b* enabling a very precise setting of the axial positions of wheels 3,4.

The shaft of polishing wheel is also associated with a control handle 8 mounted on the quill 3*a* and which enables, by actuation of the handle 8, axial displacement of the right hand part of the shaft and the wheel 3 from a rest position shown in full lines to an extreme forward operative position shown in a chain line. These two positions are limited by stops, not shown, and the micrometer 3*b* serves to accurately set the extreme forward or operative position.

If desired, the quill 3*a* may have two micrometers serving as limit stops and serving to accurately define its two extreme positions, rest and operative.

The micrometer screws 3*b*, 4*b* enable the forward operative faces 3S, 4S of the wheels 3,4 the planar faces of the wheels facing toward the right in FIG. 1 to be set in the same plane. To do this, firstly the grinding wheel 4 is set by micrometer 4*b* in its position for grinding the tool 5. Then the extreme forward position of polishing wheel 3 is set by acting on micrometer 3*b* so that when the handle 8 is actuated to bring the wheel 3 into this extreme position, the plane of the operative face of wheel 3 coincides exactly with that of wheel 4.

A motor 9 drives the wheels 3 and 4 via a belt 11 driving a double pulley 12 coaxial with shaft 7 and a second belt 13 of pulley 12 driving the shafts of wheels 3,4.

The support 2 is pivotable about its shaft 7 between two positions defined by means of a pointer 16 penetrating into either of two notches 18 in an arcuate piece 17 fixed on the support 2.

In the upper position of support 2, shown in FIG. 1 and in full lines in FIG. 2, the grinding wheel 4 faces the tool 5 to be ground.

In the lower position of support 2, shown in a chain line in FIG. 2, this polishing wheel 3 is lowered to face the tool 5. When wheel 3 has been lowered, the handle 8 is manually actuated to bring the wheel 3 into its extreme forward position in which its operative face 3S is disposed in exactly the same plane as had formerly been occupied by the operative face of the wheel 4 during grinding. This manual actuation of the handle 8 can also be carried out before the lowering of the support 2. It can be carried out during each successive operating cycle, without any danger of damaging the wheel 3 or the tool 5.

A handle 20 is provided for manually moving the support 2 between its two positions, this movement being facilitated by a counterweight, not shown, which counter-balances the weight of support 2 and the parts it carries. The handle 20 may include means for disengaging the pointer 16 to unlock the support 2.

In the embodiment of FIGS. 3 and 4, the machine has a frame 31 on which a support 32 is slidably mounted in a vertical slide 37. The support 32 carries wheels 34,33 for successively grinding and polishing a tool 35 carried by a workpiece carrier 36 of known type.

The shafts of wheels 33,34 are mounted in parallel quills 33*a*, 34*a* carried by the support 32. These shafts are parallel and equidistant from the vertical slide 37.

The quills 33*a*, 34*a* have micrometer screws for setting the axial position of wheel 34 and an extreme axial position of wheel 33, which is associated with a handle 38 for moving it into its extreme position, in the same manner as explained for the first embodiment.

A motor 39 in support 32 drives the shafts of the two wheels 33,34 by a single belt.

The support 32 can be fixed on the slide 37 in two positions defined by positioning means similar to those of the first embodiment, namely a pointer and notches. In the upper position, shown in full lines in FIG. 4, the grinding wheel 34 is in its operative positon facing the tool 35. In the lower position, shown in a chain line in FIG. 4, the polishing wheel 33 comes to occupy the position formerly occupied by wheel 34, its operative face being moved to its extreme position (shown in full lines in FIG. 3) by actuation of the handle 38.

A handle 40 is provided on support 32 to enable it to be manually moved between its two positions, a counterweight 41 being provided to facilitate this.

Figure 5:
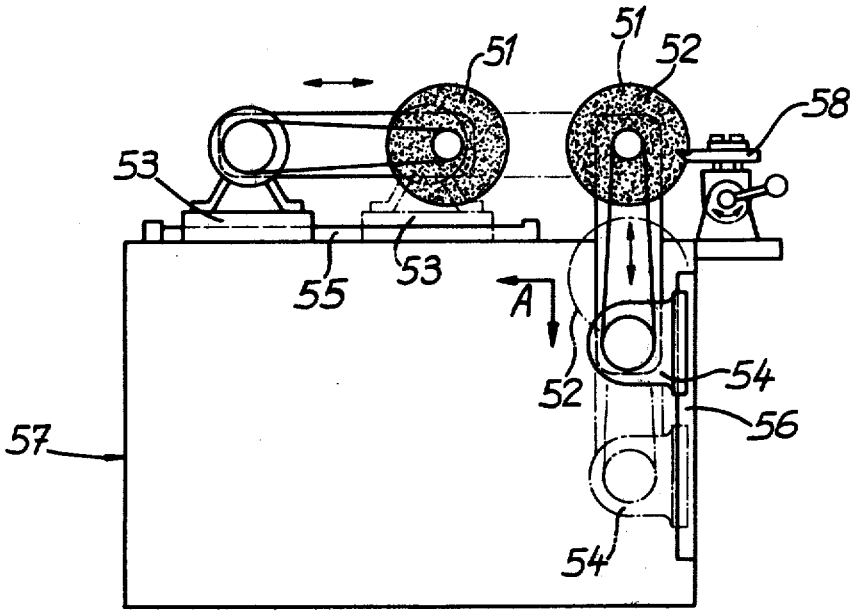
FIG. 5 is an elevational view of a variation.

FIG. 5 schematically shows a varied form of mounting of polishing and grinding wheels 51,52 on separate supports 53,54 sliding in respective horizontal and vertical slides 55,56 on a frame 57. For grinding, the wheel 52 is raised facing tool 58 and wheel 51 retracted, as shown in full lines, whereas for polishing, the wheel 52 is lowered and the wheel 51 is advanced, as indicated in chain lines. These movements of supports 53,54 may be independent or linked. This variation concerns only the disposition of the supports and, of course, the previously-described means for accurately setting a limiting position of the polishing wheel and moving the polishing wheel to this position will also be provided.

Figure 7:
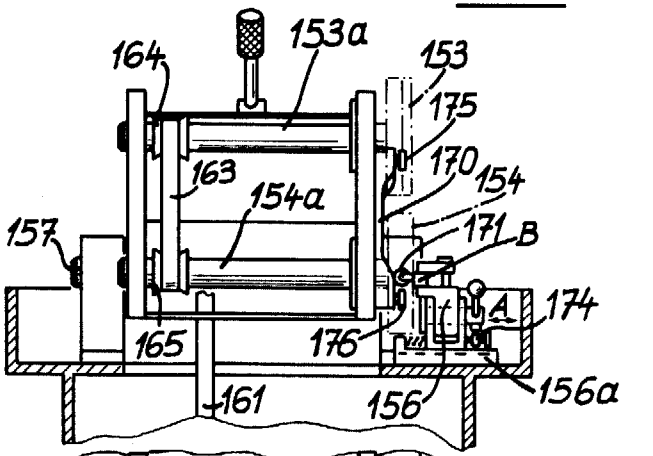
FIG. 7 is a partial end elevational view of the third embodiment, looking from the left of FIG. 6.
Figure 8:
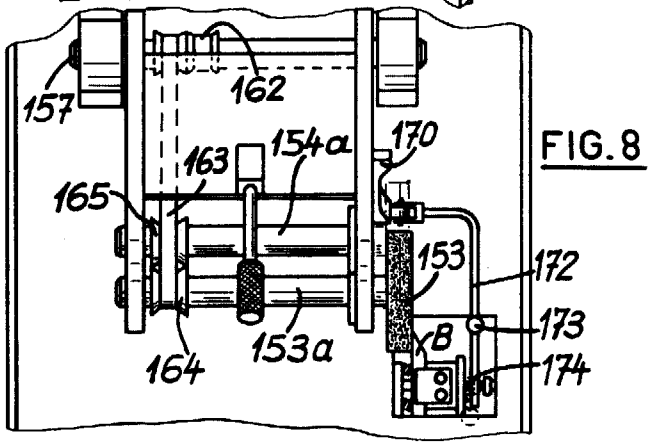
FIG. 8 is a partial plan view of the third embodiment.
Figure 6:
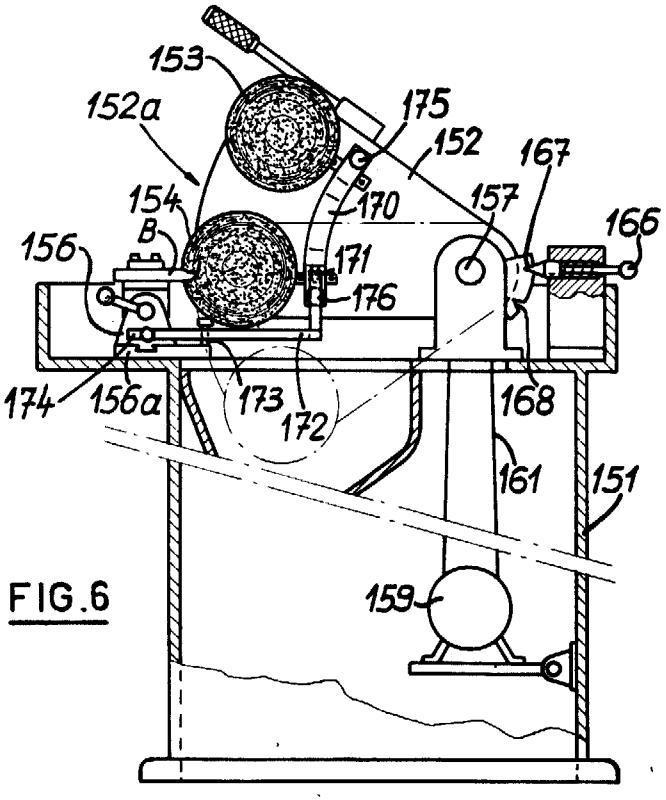
FIG. 6 is schematic side elevational view of the third embodiment, partly in cross-section.

The machine shown in FIGS. 6, 7 and 8 comprises a frame 151 on which a support 152 is pivotally mounted about a shaft 157. This support 152 carries two rotatable wheels 154,153 respectively for grinding and then polishing a tool B carried by a workpiece-carrier 156 of known type which is slidable as indicated by arrow A in a slide 156*a* in a direction parallel to the axes of wheels 153,154, i.e. perpendicular to their operative faces.

The shafts of wheels 153,154 are rotatably mounted in parallel quills 153*a*, 154*a*, carried by support 152. These shafts are parallel and equidistant from the shaft 157.

A motor 159 drives, by a belt 161 and a double pulley 162, a driving belt 163 passing about pulleys 164 and 165 fixed on the shafts of wheels 153 and 154.

The support 152 can be pivoted about its shaft 157 between two positions in which it can be held by means of a pointer 166 engaging in either of two notches 167,168 in an arcuate piece carried by the support 152.

The wheels 153 and 154 generally are of different thickness so that the operative faces of these wheels are located in different planes. In knowm machines of this type, it has heretofore been necessary, each time, to adjust the position of the workpiece carrier to bring the tool in the correct position on the operative surfaces. An error in positioning - even a very small error — is liable to cause damage to the wheel. This is a serious problem, as the polishing wheel is usually made of a very expensive diamond composite.

In this embodiment, the drawback is obviated by providing a device for displacing the workpiece carrier. This device comprises an adjustable cam 170 fixed on the support 152 and moving in front of a cam follower 171 fixed to one end of an arm 172 pivotally mounted on the frame 151 at 173. The other end 174 of the arm 172 is linked to the workpiece carrier 156 to drive it in the direction of arrow A.

The position of the two protruding ends of the adjustable cam 170 may be very precisely set by means of micrometer screws 175, 176, according to the difference of thickness of the two wheels 153,154, in such a manner that the tool B is exactly placed on the operative surface of each wheel when passing from one wheel to the other. Thus, this setting is accomplished once and for all when the two wheels have been mounted, apart from possible re-setting to compensate wear of the wheels.

A similar arrangement can be provided for displacing the workpiece-carrier radially of the operative wheel when grinding and polishing are carried out on the periphery of the wheels. In this instance, the adjustable cam would for example be secured on the part 152*a* of the support 152.

Also, it would be possible to replace the manually-operable handle 8, 38 of the two first embodiments by means for automatically moving the polishing wheel to its extreme position in response to movement of the support to its second position.

The described machines are simple to use and enable the avoidance of all errors of positioning the operative wheel relative to the tool being ground and polished. The machines are also of simple and economic construction.

What is claimed is:

1. A machine for successively grinding and polishing workpieces, in particular tools such as gravers of hard metal, comprising:

a frame;

a workpiece carrier on the frame;

a grinding wheel and a polishing wheel rotatably mounted about parallel axes and having a support movable relative to the frame between a first position in which an operative surface of the grinding wheel is placed to grind a workpiece carried by the carrier and a second position in which an operative surface of the polishing wheel is placed to polish the workpiece;

means for mounting a movable one of the polishing wheel and the workpiece carrier for movement relative to the other and relative to the grinding wheel in a direction parallel to the axes and for precisely setting an extreme position of the movable one of the polishing wheel and workpiece carrier in said direction to limit its movement towards the other, so that in the extreme position when the support is the second position the operative surface of the polishing wheel is accurately positioned relative to the workpiece in the same position as the operative surface of the grinding wheel when the support is in the first position; and means for moving the movable one of the polishing wheel and workpiece carrier into the extreme position;

the workpiece-carrier being movable in said direction, the means for moving comprising a cam track cooperating with a cam-follower to move the workpiece-carrier in response to movement of said support between the first and second positions, and the means for setting comprising means for adjusting the position of the cam track.

2. A machine according to claim 1, in which the cam-track is disposed on the support.

3. A machine for grinding and thereafter polishing workpieces such as gravers of hard metal, comprising:

a frame;

a workpiece carrier unit mounted thereon;

a wheel support;

a grinding wheel and a polishing wheel unit both mounted on the support for cooperating with the workpiece carrier unit in a succession of cycles of grinding and polishing operations, the polishing wheel unit having a polishing wheel; means for mounting the wheel support on the frame for transfer to a first position for grinding a workpiece on the carrier unit and a second position for polishing the ground workpiece on the carrier unit in the several operations of each cycle, the wheels having mutually parallel axes and plane operative surfaces normal to the axes, and having means for rotating the wheels;

adjusting means for adjusting the mounting of the workpiece carrier unit, relative to the polishing wheel unit and to the grinding wheel, in a direction parallel to the axes to compensate for wearing of the plane operative surfaces by placing the polishing wheel's operative surface in the exact plane of the grinding wheel's operative surface and thereby to position the grinding and polishing wheels relative to one another for the succession of cycles, the adjusting means comprising a cam track having a cam-follower mounted for movement thereon to move the workpiece-carrier unit in response to movement of the wheel support between the first and second positions, the adjusting means also including means for adjusting a position of the cam track; and transferring means for the transfer of the wheel support between the first and second positions thereof, in a movement parallel to the operative surfaces;

whereby in the use of the wheels upon the adjusting of the mounting, damage to the polishing wheel and to the workpiece is prevented upon each transfer of the wheel support to the second position thereof.

4. A machine according to claim 3, in which the cam-track is disposed on and secured to the wheel support.

* * * * *